US011545076B2

(12) United States Patent
Aoki et al.

(10) Patent No.: US 11,545,076 B2
(45) Date of Patent: Jan. 3, 2023

(54) DISPLAY DEVICE HAVING A RESET LINE FOR SUPPLYING A RESET SIGNAL

(71) Applicant: Japan Display Inc., Tokyo (JP)

(72) Inventors: Yoshinori Aoki, Tokyo (JP); Akihiro Ogawa, Tokyo (JP); Masanobu Ikeda, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 17/366,303

(22) Filed: Jul. 2, 2021

(65) Prior Publication Data

US 2022/0005405 A1 Jan. 6, 2022

(30) Foreign Application Priority Data

Jul. 6, 2020 (JP) ..... JP2020-116275

(51) Int. Cl.
*G09G 3/32* (2016.01)
*G09G 3/20* (2006.01)

(52) U.S. Cl.
CPC ..... *G09G 3/32* (2013.01); *G09G 3/2003* (2013.01); *G09G 2300/0452* (2013.01); *G09G 2310/0267* (2013.01); *G09G 2330/028* (2013.01)

(58) Field of Classification Search
CPC ..... G09G 2300/0452; G09G 2310/0267; G09G 2330/028; G09G 3/2003; G09G 3/32
See application file for complete search history.

(56) References Cited

U.S. PATENT DOCUMENTS 10,319,297 B2 * 6/2019 Morita ..... G02F 1/13452
2004/0252249 A1 * 12/2004 Hong ..... G09G 3/3614 349/37
2005/0093802 A1 * 5/2005 Yamazaki ..... H01L 27/3276 315/169.3
2005/0242743 A1 * 11/2005 Kwak ..... G09G 3/3233 345/209
2007/0195043 A1 * 8/2007 Furuie ..... H01L 27/3279 345/92
2011/0267327 A1 * 11/2011 Hwang ..... G09G 3/3208 345/83
2014/0111557 A1 * 4/2014 Omata ..... G09G 3/3233 345/76
2014/0320385 A1 * 10/2014 Kwon ..... G09G 3/3233 345/82

(Continued)

FOREIGN PATENT DOCUMENTS

JP 2020-052154 A 4/2020
JP 2020-052155 A 4/2020

*Primary Examiner* — Kenneth Bukowski
(74) *Attorney, Agent, or Firm* — Michael Best & Friedrich LLP

(57) ABSTRACT

According to one embodiment a display device includes first and second sub-pixels, first and second power lines, and a reset line. The first sub-pixel includes a first light emitting element and a first pixel circuit. The second sub-pixel includes a second light emitting element and a second pixel circuit. The first power line supplies power to the first pixel circuit. The second power line supplies power to the second pixel circuit. Reset signal is supplied to the reset line. The reset line and the power lines are arranged in a display region. The reset line is connected to both the pixel circuits. A width of the first power line is larger than a width of the second power line.

9 Claims, 8 Drawing Sheets

(56) References Cited

U.S. PATENT DOCUMENTS

| | | | | |
|---|---|---|---|---|
| 2015/0187272 | A1* | 7/2015 | Kimura | G09G 3/3258 345/694 |
| 2016/0372049 | A1* | 12/2016 | Wang | G09G 3/3283 |
| 2020/0161399 | A1* | 5/2020 | Park | H01L 27/326 |
| 2020/0380920 | A1* | 12/2020 | Lee | G09G 3/3291 |
| 2021/0150977 | A1* | 5/2021 | Ryu | H01L 27/3276 |
| 2021/0319754 | A1* | 10/2021 | Shang | G09G 3/3291 |
| 2021/0320164 | A1* | 10/2021 | Lee | G09G 3/3258 |
| 2021/0343764 | A1* | 11/2021 | Miyamoto | H04N 5/3698 |
| 2021/0408153 | A1* | 12/2021 | Sun | H01L 27/3216 |

* cited by examiner

DISPLAY DEVICE HAVING A RESET LINE FOR SUPPLYING A RESET SIGNAL

CROSS-REFERENCE TO RELATED APPLICATIONS

This application is based upon and claims the benefit of priority from Japanese Patent Application No. 2020-116275, filed Jul. 6, 2020, the entire contents of which are incorporated herein by reference.

FIELD

Embodiments described herein relate generally to a display device.

BACKGROUND

Display devices using light-emitting diodes (LED) as display elements are known. Recently, a display device in which a minute light-emitting diode referred to as a micro-LED is mounted on an array substrate has also been developed. The display device of this type can display high quality images and is focused as a next-generation display device.

To increase the luminance in the display device using a self-luminous display device such as a micro-LED, measures such as increasing a width of a power line supplying the power to the display device are required. In a high definition display device, however, space to arrange lines and circuits in a display region is limited and increase in the luminance may be difficult.

DETAILED DESCRIPTION

Figure 1:
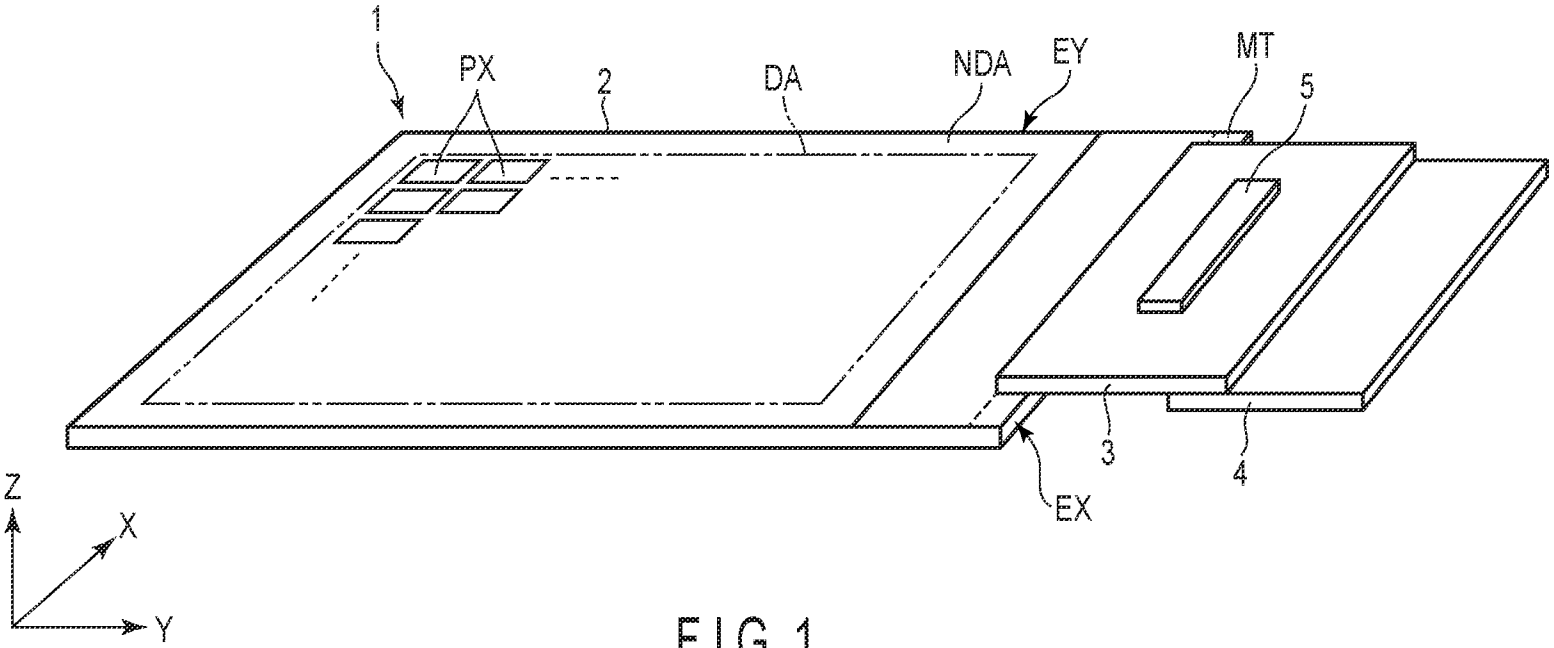
FIG. 1 is a schematic perspective view showing a display device according to one of embodiments.

In general, according to one of the embodiments a display device includes a first sub-pixel, a second sub-pixel, a first power line, a second power line, and a reset line. The first sub-pixel includes a first light emitting element and a first pixel circuit driving the first light emitting element. The second sub-pixel includes a second light emitting element and a second pixel circuit driving the second light emitting element. The first power line supplies power to the first pixel circuit. The second power line supplies power to the second pixel circuit. A reset signal for resetting voltages of the first light emitting element and the second light emitting element is supplied to the reset line. The reset line, the first power line, and the second power line are arranged in a display region including the first sub-pixel and the second sub-pixel. The reset line is connected to both the first pixel circuit and the second pixel circuit. A width of the first power line is larger than a width of the second power line.

According to another aspect of the embodiment, a display device includes a first sub-pixel, a second sub-pixel, a third sub-pixel, a first video line, a second video line, a third video line, and a reset line. The first sub-pixel includes a first light emitting element and a first pixel circuit driving the first light emitting element. The second sub-pixel includes a second light emitting element and a second pixel circuit driving the second light emitting element. The third sub-pixel includes a third light emitting element and a third pixel circuit driving the third light emitting element. The first video line supplies a video signal to the first pixel circuit. The second video line supplies a video signal to the second pixel circuit. The third video line supplies a video signal to the third pixel circuit. A reset signal for resetting voltages of the first light emitting element, the second light emitting element, and the third light emitting element is supplied to the reset line. The first video line, the reset line, the second video line, and the third video line are arranged in this order in the first direction. The first video line, the second video line, and the third video line extend in a second direction intersecting the first direction. The reset line includes a wiring part extending in the second direction at a position between the first video line and the second video line, and a bridge part intersecting the second video line and the third video line and extending in the first direction.

According to each of the above-described configurations, a display device capable of achieving the increase in the luminance can be provided.

One of various embodiments will be described hereinafter with reference to the accompanying drawings.

The disclosure is merely an example, and proper changes in keeping with the spirit of the invention, which are easily conceivable by a person of ordinary skill in the art, come within the scope of the invention as a matter of course. In addition, in some cases, in order to make the description clearer, the drawings may be more schematic than in the actual modes, but they are mere examples, and do not limit the interpretation of the present invention. In the drawings, reference numbers of continuously arranged elements equivalent or similar to each other are omitted in some cases. In addition, in the specification and drawings, the same elements as those described in connection with preceding drawings are denoted by like reference numbers, and detailed description thereof is omitted unless necessary.

A self-luminous display device comprising an LED device is disclosed as an example in each embodiment. However, each of the embodiments does not preclude the application of individual technical ideas disclosed in the embodiments to, for example, display devices comprising display elements of the other types such as an organic electroluminescent device.

FIG. 1 is a schematic perspective view showing a display device 1 according to the embodiment. In the following descriptions, a first direction X, a second direction Y and a third direction Z are defined as shown in the drawing. These directions X, Y, and Z are orthogonal to each other, but may intersect at an angle other than 90 degrees. In the embodiment, viewing the display device 1 and the components thereof along the third direction Z is referred to as planar view. In addition, the third direction Z may be referred to as an upward direction, and a direction opposite to the third direction Z may be referred to as a downward direction.

The display device 1 comprises a display panel 2, a first circuit board 3, a second circuit board 4, and a controller 5. In the example of FIG. 1, the display panel 2 has a rectangular shape having shorter sides EX parallel to the first direction X and longer sides EY parallel to the second direction Y. The third direction Z corresponds to a thickness direction of the display panel 2.

The display panel 2 includes a display region DA on which an image is displayed, and a non-display region NDA (peripheral region) around the display region DA. The non-display region NDA includes a terminal region MT elongated along the shorter sides EX. In the embodiment, the display region DA has a rectangular shape, but the display region DA may have the other shape. In the display region DA, a plurality of pixels PX arrayed in a matrix in the first direction X and the second direction Y are arranged.

The first circuit board 3 is mounted on the terminal region MT and is electrically connected to the display panel 2. The second circuit board 4 is electrically connected to the first circuit board 3. The first circuit board 3 is, for example, a flexible printed circuit (FPC). The second circuit board 4 is, for example, a printed circuit board (PCB). The controller 5 is, for example, an integrated circuit (IC). In the example of FIG. 1, the controller 5 is mounted on the first circuit board 3. However, the controller 5 may be mounted under the first circuit board 3, in the non-display region NDA, or on the second circuit board 4.

The controller 5 is connected to a control board (not shown) via, for example, the second circuit board 4. The controller 5 drives a plurality of pixels PX, based on a video signal output from the control board.

Figure 2:
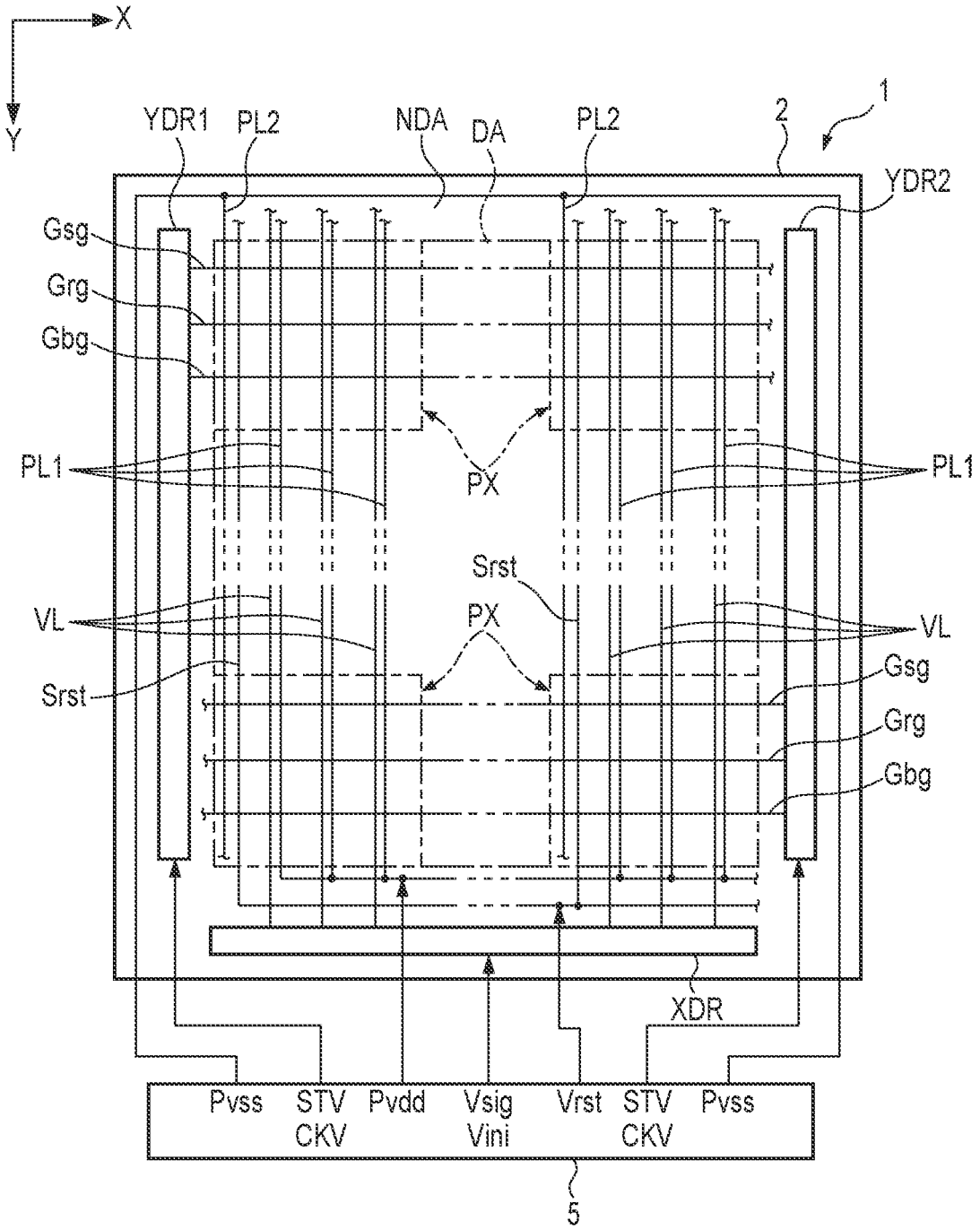
FIG. 2 is a schematic circuit diagram showing a display device according to the embodiment.

FIG. 2 is a schematic circuit diagram showing the display device 1 according to the embodiment. The display panel 2 comprises a video driver XDR, a first scanning driver YDR1, and a second scanning driver YDR2, in the non-display region NDA. The video driver XDR extends in the first direction X. The scanning drivers YDR1 and YDR2 extend in the second direction Y. The display region DA is located between the scanning drivers YDR1 and YDR2.

The display panel 2 comprises a plurality of types of lines in the display region DA. These lines include a plurality of scanning lines Gsg, Grg, and Gbg, a plurality of video lines VL, a plurality of power lines PL1, a plurality of power lines PL2, and a plurality of reset lines Srst.

The scanning lines Gsg, Grg, and Gbg extend in the first direction X and are connected to the scanning drivers YDR1 and YDR2. For example, of the pixels PX arranged in the second direction Y, the scanning lines Gsg, Grg, and Gbg to drive even-numbered pixels PX are connected to the first scanning driver YDR1, and the scanning lines Gsg, Grg, and Gbg to drive odd-numbered pixels PX are connected to the second scanning driver YDR2. As another example, for example, all the scanning lines Gsg and Grg may be connected to the first scanning driver YDR1 and all the scanning lines Gbg may be connected to the second scanning driver YDR2, i.e., any of the scanning lines Gsg, Grg, and Gbg may be connected to the first scanning driver YDR1 and the remaining scanning lines may be connected to the second scanning driver YDR2.

The video lines VL, the power lines PL1 and PL2, and the reset lines Srst extend in the second direction Y. The video lines VL are connected to the video driver XDR. The video lines VL are supplied with a video signal Vsig and an initialization signal Vini from the video driver XDR. The power lines PL1 are supplied with a high potential Pvdd from the controller 5. The power lines PL2 are supplied with a low potential Pvss which is lower than the high potential Pvdd from the controller 5. The reset signals Srst are supplied with a reset signal Vrst from the controller 5.

The controller 5 also outputs a start pulse signal STV and a clock signal CKV to the scanning drivers YDR1 and YDR2. The scanning drivers YDR1 and YDR2 include a plurality of shift register circuits, and sequentially transfer start pulse signals STV to the shift register circuit of the next stage in accordance with the clock signals CKV and sequentially supply the scanning signals to each of the scanning lines Gsg, Grg, and Gbg.

Figure 3:
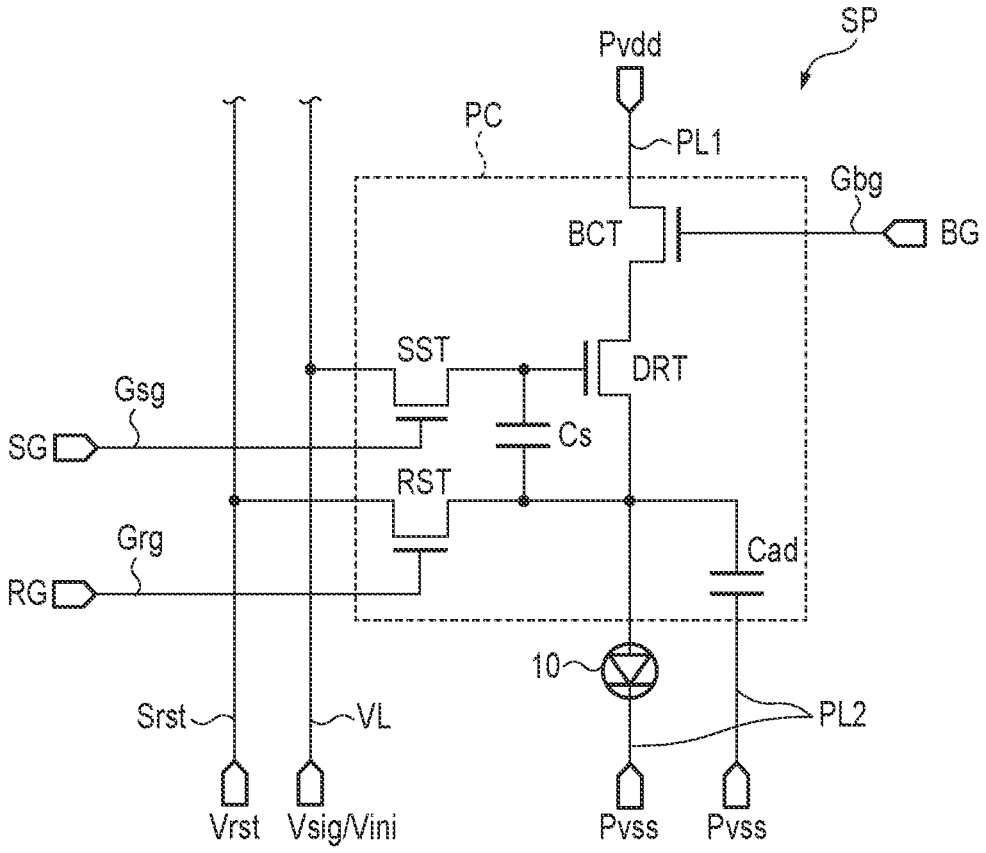
FIG. 3 is view showing an example of an equivalent circuit of a sub-pixel according to the embodiment.

FIG. 3 is a diagram showing an example of an equivalent circuit of a sub-pixel SP included in the pixel PX. The sub-pixel SP comprises a light emitting element 10 and a pixel circuit PC that drives the light emitting element 10. In the embodiment, it is assumed that the light emitting element 10 is a micro-light-emitting diode (micro-LED). That is, the display device 1 is a micro-LED display device.

For example, the length of the longest side is 100 μm or less in the light emitting element 10 which is a micro-LED. However, for example, the light emitting element 10 may be a mini-LED in which the length of the longest side is 100 μm or more and is less than 300 μm. Alternatively, the light emitting element 10 may be an LED in which the length of the longest side is 300 μm or more.

The pixel circuit PC controls the light emitting element 10 in accordance with the video signal Vsig supplied to the video line VL. To implement this control, the pixel circuit PC of the embodiment includes a reset transistor RST, a pixel select transistor SST, an output transistor BCT, a drive transistor DRT, a storage capacitor Cs, and an auxiliary capacitor Cad. The auxiliary capacitor Cad is an element provided to adjust the amount of the emission current and may be unnecessary in some cases.

The reset transistor RST, the pixel select transistor SST, the output transistor BCT, and the drive transistor DRT can be configured by, for example, N-channel TFTs, but at least one of them may be configured by a P-channel TFT.

In the embodiment, the reset transistor RST, the pixel select transistor SST, the output transistor BCT, and the drive transistor DRT are formed to comprise the same layer structure by the same process, and have a bottom-gate structure using polycrystalline silicon for the semiconductor layer. As another example, the reset transistor RST, the pixel select transistor SST, the output transistors BCT, and the drive transistor DRT may have a top-gate structure. Incidentally, an oxide semiconductor, a polycrystalline GaN semiconductor or the like may be used as the semiconductor layer.

Each of the reset transistor RST, the pixel select transistor SST, the output transistor BCT, and the drive transistor DRT includes a first terminal, a second terminal, and a control terminal. In the descriptions of FIG. 3, the first terminal is referred to as a source electrode, the second terminal is referred to as a drain electrode, and the control terminal is referred to as a gate electrode.

The drive transistor DRT and the output transistor BCT are connected in series with the light emitting element 10 at positions between the power line PL1 and the power lines PL2. The high potential Pvdd is set, for example, to 10V in power line PL1, and, for example, low potential Pvss supplied to power line PL2 is set to 1.5V.

A drain electrode of the output transistors BCT is connected to the power line PL1. A source electrode of the output transistor BCT is connected to a drain electrode of the drive transistor DRT. A gate electrode of the output transistor BCT is connected to the scanning line Gbg. The output transistor BCT is turned on and off by a control signal BG supplied to the scanning line Gbg. Turning on is referred to as a conductive state, and turning off is referred to as a non-conductive state. The output transistor BCT controls the emission time of the light emitting element 10, based on the control signal BG.

A source electrode of the drive transistor DRT is connected to one of electrodes (in this example, anode) of the light emitting element 10. The other electrode (in this example, cathode) of the light emitting element 10 is connected to the power line PL2. The drive transistor DRT outputs a drive current corresponding to the video signal Vsig to the light emitting element 10.

A source electrode of the pixel select transistor SST is connected to the video line VL. A drain electrode of the pixel select transistor SST is connected to a gate electrode of the drive transistor DRT. A gate electrode of the pixel select transistor SST is connected to the scanning line Gsg that functions as a gate line for signal write control. The pixel select transistor SST is turned on and off by a control signal SG supplied from the scanning line Gsg to change connection and disconnection of the pixel circuit PC and the video line VL. That is, the video signal Vsig or the initialization signal Vini of the video line VL is supplied to the gate electrode of the drive transistor DRT by turning on the pixel select transistor SST.

A source electrode of the reset transistor RST is connected to the reset line Srst. A drain electrode of the reset transistor RST is connected to the source electrode of the drive transistor DRT and the anode of the light emitting element 10. A gate electrode of the reset transistor RST is connected to the scanning line Grg that functions as a gate line for reset control. The reset transistor RST is turned on and off by the control signal RG supplied from the scanning line Grg. The potentials of the source electrode of the drive transistor DRT and the anode of the light emitting element 10 can be reset to the reset signal Vrst of the reset line Srst by changing the reset transistor RST to be turned on. That is, the reset line Srst is the line for resetting the voltage of the light emitting element 10.

The storage capacitor Cs is connected between the gate electrode and the source electrode of the drive transistor DRT. The auxiliary capacitor Cad is connected between the source electrode of the drive transistor DRT and the power line PL2.

In the above-described configuration, the pixel circuit PC is driven by the control signals SG, RG, and BG supplied to the scanning lines Gsg, Grg, and Gbg, and the light emitting element 10 emits light with the luminance that responds to the video signal Vsig of the video line VL.

The scanning drivers YDR1 and YDR2 sequentially supply the control signals SG, RG, and BG to the scanning lines Gsg, Grg, and Gbg of the respective lines (a series of sub-pixels SP arranged in the first direction X), based on the above-described start pulse signal STV and clock signal CVK. In addition, the video driver XDR sequentially supplies the video signal Vsig and the initialization signal Vini to each video line VL, based on the signal supplied from the controller 5 shown in FIG. 2. The charges stored in the storage capacitor Cs in accordance with supply of the video signal Vsig are initialized in accordance with supply of the initialization signal Vini.

Figure 4:
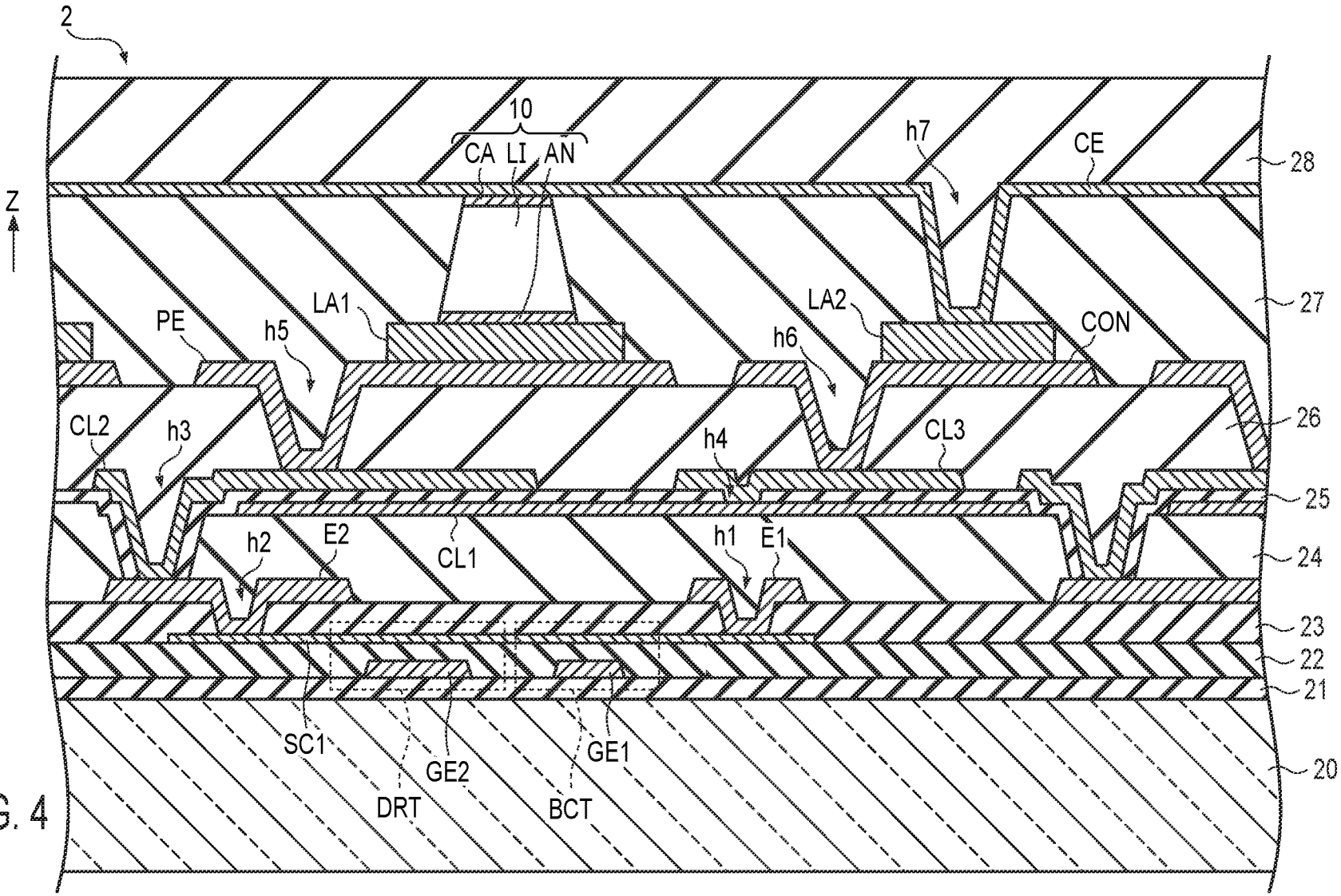
FIG. 4 is a schematic cross-sectional view showing a display device according to the embodiment.

FIG. 4 is a cross-sectional view schematically showing the display panel 2. The structure corresponding to a part of the pixel PX (sub-pixel SP) is shown. The display panel 2 comprises an insulating base 20, insulating layers 21, 22, 23, 24, 25, and 26 provided on the insulating base 20, a resin layer 27, and a coating layer 28.

The insulating base 20 is, for example, glass but may be a resin substrate having flexibility such as polyimide. The insulating layer 11 is provided on the insulating base 20. A first gate electrode GE1 and a second gate electrode GE2 are provided on the insulating layer 21. The gate electrodes GE1 and GE2 and the insulating layer 21 are covered with the insulating layer 22. A semiconductor layer SC1 is provided on the insulating layer 22. The semiconductor layer SC1 and the insulating layer 23 are covered with the insulating layer 23. A first electrode E1 and a second electrode E2 are provided on the insulating layer 23. The first electrode E1 and the second electrode E2 are in contact with the semiconductor layer SC1 through contact holes h1 and h2 that penetrate the insulating layer 23, respectively.

The first gate electrode GE1 and a part of the semiconductor layer SC1 configure the output transistor BCT. The second gate electrode GE2 and the other part of the semiconductor layer SC1 configure the drive transistor DRT. Though not shown in FIG. 4, the above-described reset transistor RST and pixel select transistor SST are formed by the same layer configuration as the output transistor BCT and drive transistor DRT.

The first electrode E1, the second electrode E2, and the insulating layer 24 are covered with the insulating layer 24. A conductive layer CL1 is provided on the insulating layer 24. The conductive layer CL1 and the insulator layer 24 are covered with an insulating layer 25.

Conductive layers CL2 and CL3 are provided on the insulating layer 25. The conductive layer CL2 is in contact with the second electrode E2 through the contact hole h3 penetrating the insulating layers 24 and 25. The conductive layer CL3 is in contact with the conductive layer CL1 through the contact hole h4 penetrating the insulating layer 25.

The conductive layers CL2 and CL3 and the insulating layer 25 are covered with an insulating layer 26. A pixel electrode PE and a contact electrode CON are provided on the insulating layer 26. The pixel electrode PE is in contact with the conductive layer CL2 through a contact hole h5 penetrating the insulating layer 26. The contact electrode CON is in contact with the conductive layer CL3 through a contact hole h6 penetrating the insulating layer 26.

A connection layer LA1 is provided on the pixel electrode PE, and a connection layer LA2 is provided on the contact electrode CON. The light emitting element 10 is provided on the connection layer LA1. The light emitting element 10 includes an anode AN, a cathode CA, and an emitting layer LI arranged between the anode AN and the cathode CA. The emitting layer LI emits light according to a potential difference between the anode AN and the cathode CA. The anode AN is in contact with the upper surface of the connection layer LA1.

The resin layer 27 covers the pixel electrode PE, the contact electrode CON, the connection layers LA1 and LA2, and the insulating layer 26 and fills clearance of a plurality of light emitting elements 10. The cathode CA is exposed from the resin layer 27.

The resin layer 27 is covered with the common electrode CE. The common electrode CE is in contact with the connection layer LA2 through a contact hole h7 provided in the resin layer 27. In addition, the common electrode CE is also in contact with the cathode CA. The common electrode CE is covered with the coating layer 28.

The insulating layers 21, 22, 23, and 25 are formed of, for example, an inorganic insulating material such as silicon oxide (SiO) or silicon nitride (SiN). The insulating layers 24 and 26 are formed of an organic insulating material such as photosensitive acrylic resin. The insulating layers 24 and 26 are thicker than the insulating layers 21, 22, 23, and 25, and function as the planarizing layers. The coating layer 28 is formed of, for example, silicon including a main chain of parylene (polyparaxylylene) or inorganic siloxane bond and a side chain of an organic bond.

The first gate electrode GE1, the second gate electrode GE2, the first electrode E1, the second electrode E2, the conductive layers CL2 and CL3, the pixel electrode PE, and the contact electrode CON are formed of metallic materials. The conductive layer CL1 and the common electrode CE are formed of a transparent conductive material such as indium tin oxide (ITO). The connection layers LA1 and LA2 are formed, for example, of solder.

The first electrode E1 is supplied with a high potential Pvdd through the above-mentioned power line PL1. The high potential Pvdd is supplied to the anode AN of the light emitting element 10 through the output transistors BCT, the drive transistor DRT, the second electrode E2, the conductive layer CL2, the pixel electrode PE, and the connection layer LA1.

The common electrode CE is supplied with a low potential Pvss through above-mentioned power line PL2. The low potential Pvss is also supplied to the cathode CA of the light emitting element 10 which is in contact with the common electrode CE. In addition, the low potential Pvss is also supplied to the conductive layer CL1 through the connection layer LA2, the contact electrode CON, and the conductive layer CL3. The conductive layer CL1 forms the above-mentioned auxiliary capacitor Cad together with the conductive layer CL2, and the like.

Figure 5:
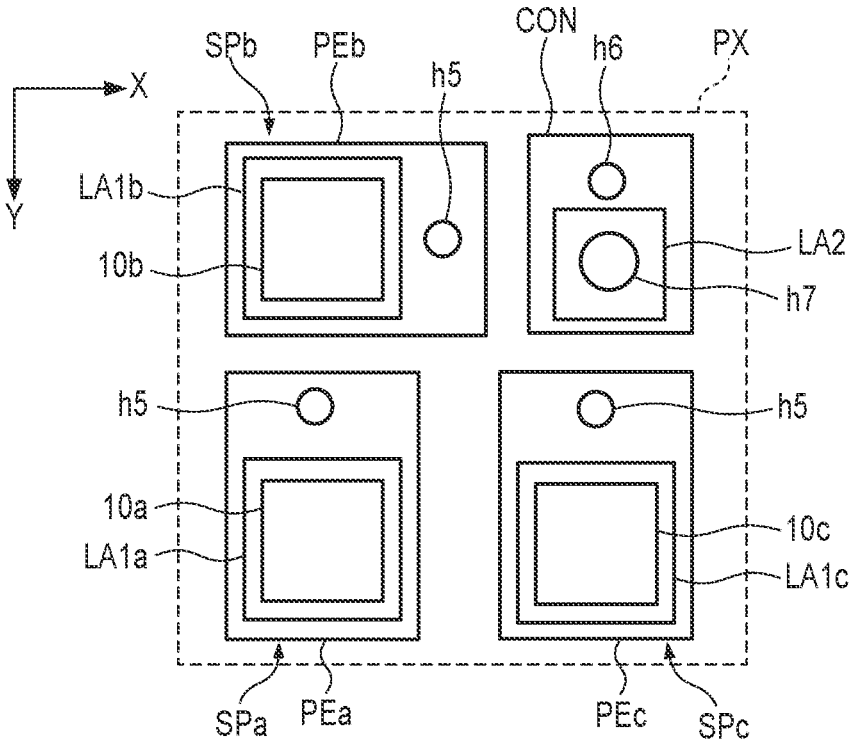
FIG. 5 is a schematic plan view showing elements included in a pixel according to the embodiment.

FIG. 5 is a plan view schematically showing parts of the elements included in the pixel PX. In the embodiment, it is assumed that the pixel PX includes three sub-pixels SPa, SPb, and SPc. The sub-pixel SPa displays red color, and sub-pixel SPb displays green color, and sub-pixel SPc displays blue color. However, the pixel PX may further include sub-pixels displaying other colors such as white color. In addition, the number of sub-pixels SP included in the pixel PX is not limited to three.

The sub-pixels SPa, SPb, and SPc have a structure shown in FIG. 3 and FIG. 4. FIG. 5 shows shapes of pixel electrodes PE (PEa, PEb, and PEc) of the respective sub-pixels SPa, SPb, and SPc, shapes of the connection layer LA1 (LA1*a*, LA1*b*, and LA1*c*) and the light emitting element 10 (10*a*, 10*b*, and 10*c*), shapes of the contact electrode CON and the connection layer LA2, and positions of the contact holes h5, h6, and h7.

In the example of FIG. 5, the pixel electrode PEa of the sub-pixel SPa and the pixel electrode PEc of the sub-pixel SPc are arranged in the first direction X, and the pixel electrode PEb of the sub-pixel SPb and the contact electrode CON are arranged in the first direction X. Furthermore, the pixel electrode PEa and the pixel electrode PEb are arranged in the second direction Y, and the pixel electrode PEc and the contact electrode CON are arranged in the second direction Y. For example, the pixel electrodes PEa, PEb, and PEc and the contact electrode CON have a rectangular shape, but the shape is not limited to this example.

The connection layer LA1*a* of the sub-pixel SPa is arranged on the pixel electrode PEa, the connection layer LA1*b* of the sub-pixel SPb is arranged on the pixel electrode PEb, the connection layer LA1*c* of the sub-pixel SPc is arranged on the pixel electrode PEc, and the connection layer LA2 is arranged on the contact electrode CON.

The light emitting element 10*a* of the sub-pixel SPa is arranged on the connection layer LA1*a*, the light emitting element 10*b* of the sub-pixel SPb is arranged on the connection layer LA1*b*, and the light emitting element 10*c* of the sub-pixel SPc is arranged on the connection layer LA1*c*. The light emitting element 10*a* is a micro-LED emitting red light, the light emitting element 10*b* is a micro-LED emitting green light, and the light emitting element 10*c* is a micro-LED emitting blue light.

Figure 6:
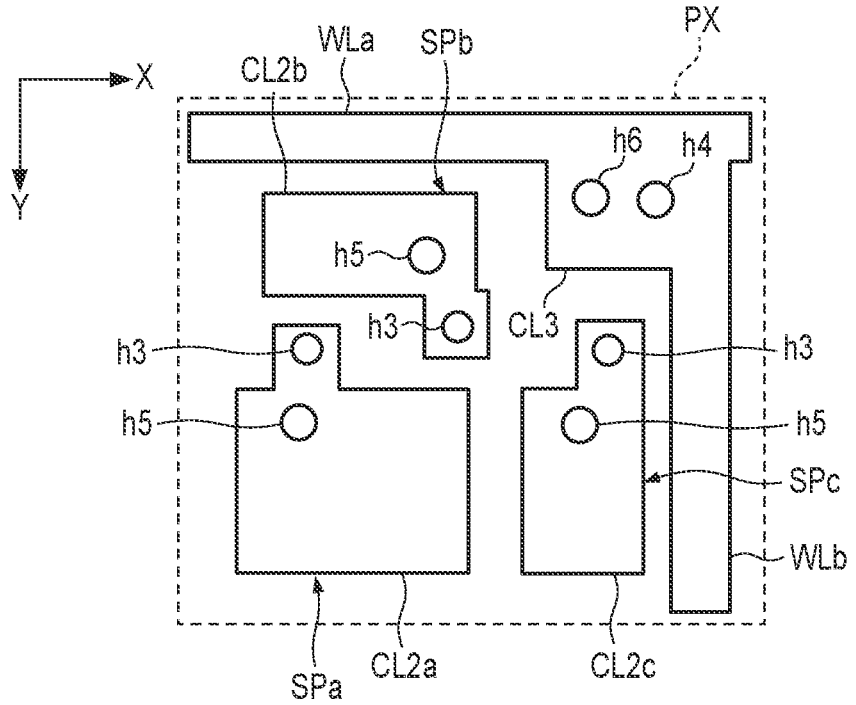
FIG. 6 is a schematic plan view showing the other elements included in the pixel according to the embodiment.

FIG. 6 is a plan view schematically showing the other elements included in the pixel PX. This figure shows shapes of the conductive layers CL2 (CL2*a*, CL2*b*, and CL2*c*) of the sub-pixels SPa, SPb, and SPc, a shape of the conductive layer CL3, and positions of the contact holes h3, h4, h5, and h6.

The conductive layer CL2*a* of the sub-pixel SPa, the conductive layer CL2*b* of the sub-pixel SPb, and the conductive layer CL2*c* of the sub-pixel SPc are located under the pixel electrodes PEa, PEb, and PEc shown in FIG. 5, respectively.

In the example of FIG. 6, the pixel PX further comprises a line WLa extending in the first direction X and a line WLb extending in the second direction Y. The lines WLa and WLb are connected to each other and are formed in the conductive layer CL3.

Figure 7:
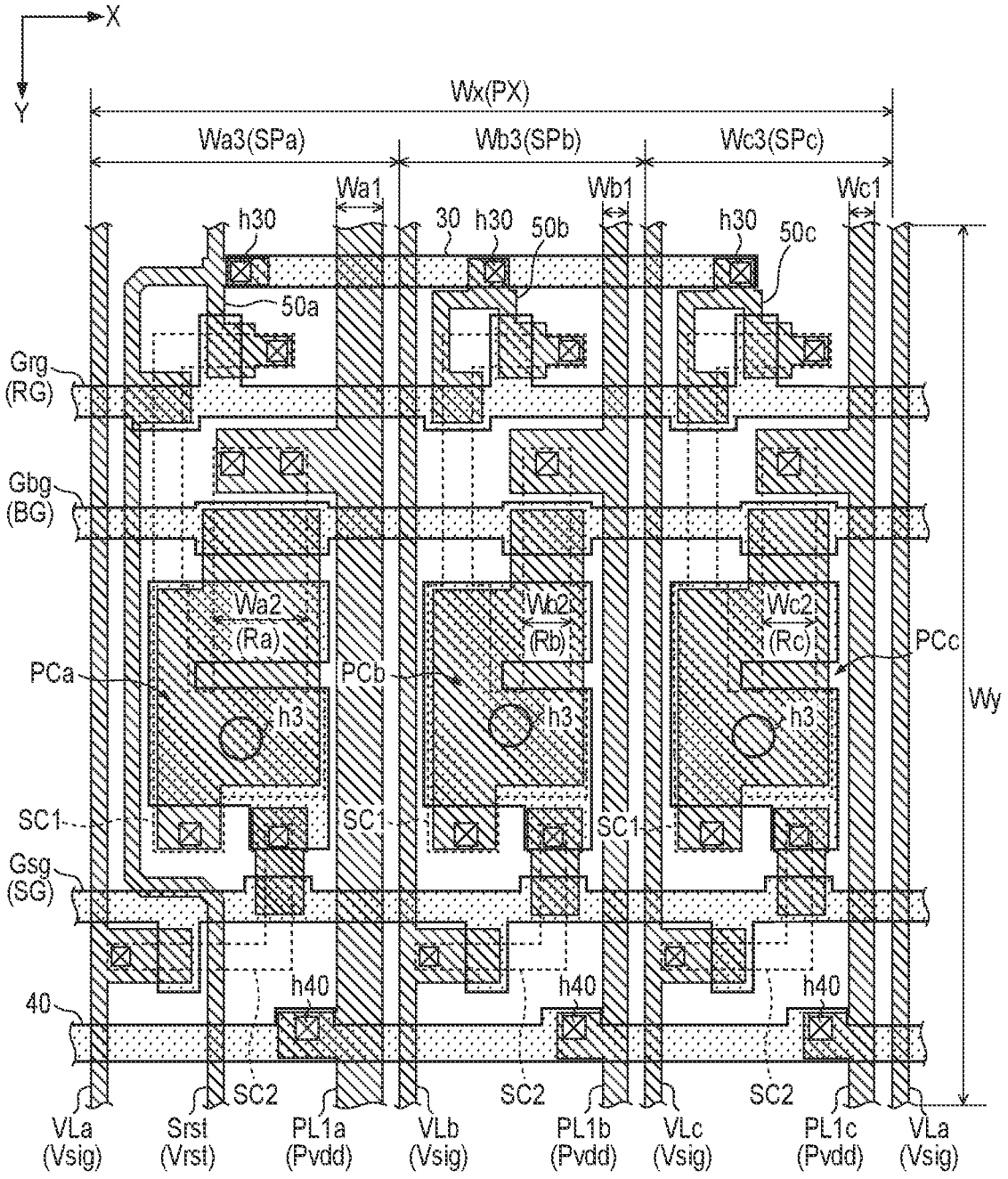
FIG. 7 is a schematic plan view further showing the other elements included in the pixel according to the embodiment.

FIG. 7 is a schematic plan view further showing the other elements included in the pixel PX. This figure shows metal conductive materials (dotted parts) arranged in the first layer between the insulating layers 21 and 22 in FIG. 4, semiconductor materials (broken line parts) arranged in the second layer between the insulating layers 22 and 23, metal conductive materials (hatched line parts) arranged in the third layer between the insulating layers 23 and 24, and the contact holes penetrating the first to third layers.

The conductive materials arranged in the first layer contain the scanning lines Grg, Gbg, and Gsg. The semiconductor materials arranged in the second layer contain semiconductor layers SC1 and SC2 forming parts of the reset transistor RST, the pixel select transistor SST, the output transistor BCT, and the drive transistor DRT. The conductive materials arranged in the third layer contain the video lines VLa, VLb, and VLc for supplying the video signal Vsig to the sub-pixels SPa, SPb, and SPc, respectively, the power lines PL1*a*, PL1*b*, and PL1*c* for supplying the high potential Pvdd to the sub-pixels SPa, SPb, and SPc, respectively, and the reset line Srst for supplying the reset signal Vrst.

In the example of FIG. 7, the video line VLa, the reset line Srst, the power line PL1*a*, the video line VLb, the power line PL1*b*, the video line VLc, and the power line PL1*c* are arranged in this order in the first direction X. The video line VLa shown at a right end of the figure supplies the video signal Vsig to the sub-pixel SPa of the other pixel PX adjacent to the pixel PX shown in the figure.

The reset line Srst is located closely to the video image line VLa, at a position between the video lines VLa and VLb. The power line PL1*a* is located closely to the video line VLb, at a position between the video lines VLa and VLb. The power line PL1*b* is located closely to the video line VLc, at a position between the video lines VLb and VLc. The power line PL1*c* is located closely to the video line VLa at a position between the video line VLa and the video line VLa of the other pixel PX.

In the example of FIG. 7, the video lines VLa, VLb, and VLc and the power lines PL1*a*, PL1*b*, and PL1*c* entirely extend parallel to the second direction Y. In contrast, the reset line Srst extends in the second direction Y while bending to bypass a part of the pixel select transistor SST, and the drive transistor DRT, output transistor BCT, and the reset transistor RST. That is, the reset line Srst includes a part extending in the first direction X and a part extending in the second direction Y.

The pixel circuit PCa of the sub-pixel SPa is arranged between the video line VLa and the power line PL1*a*. The pixel circuit PCb of the sub-pixel SPb is arranged between the video line VLb and the power line PL1*b*. The pixel circuit PCc of the sub-pixel SPc is arranged between the video line VLc and the power line PL1*c*.

The pixel circuit PCa includes a relay electrode 50*a* arranged between the video line VLa and the power line PL1*a*. The pixel circuit PCb includes a relay electrode 50*b* arranged between the video line VLb and the power line PL1*b*. The pixel circuit PCc includes a relay electrode 50*c* arranged between the video line VLc and the power line PL1*c*. The relay electrodes 50*a*, 50*b*, and 50*c* are arranged in the third layer. The relay electrode 50*a* extends from the reset line Srst. The relay electrodes 50*b* and 50*c* are formed in an island-like shape. The relay electrodes 50*a*, 50*b*, and 50*c* can be defined as parts of the reset line Srst.

A first bridge 30 formed in the first layer is arranged near the relay electrodes 50*a*, 50*b*, and 50*c*. The first bridge 30 intersects the video lines VLb and VLc and the power lines PL1*a* and PL1*b* and extends in first direction X. An end of the first bridge 30 is located between the video line VLa and the power line PL1*a*, and the other end thereof is located between the video line VLc and the power line PL1*c*. The reset line Srst is connected to the first bridge 30 through a contact hole h30 which penetrates the insulating layers 22 and 23 shown in FIG. 4, at a position between the video line VLa and the power line PL1*a*. The relay electrode 50*b* is connected to the first bridge 30 through the contact hole h30 at a position between the video line VLb and the power line PL1*b*. The relay electrode 50*c* is connected to the first bridge 30 through the contact hole h30 at a position between the video line VLc and the power line PL1*c*. The contact hole h30 penetrates the third insulating layers 22 and 23 shown in FIG. 4.

Thus, the reset line Srst is connected to the pixel circuit PCa via the relay electrode 50*a* and is connected to the pixel circuits PCb and PCc via the first bridge 30 and the relay electrodes 50*b* and 50*c*. The reset signal Vrst can be thereby supplied to each of the pixel circuits PCa, PCb, and PCc by one reset line Srst. Incidentally, the first bridge 30 can also be defined as a part of the reset line Srst. In this case, the reset line Srst includes a wiring part extending in the second direction Y at the position between the video line VLa and the video line VLb (i.e., the part represented by the hatched lines in FIG. 7), and a bridge part (first bridge 30) intersecting the video line VLb and the video line VLc and extending in the first direction X.

A second bridge 40 formed in the first layer is arranged under the canning line Gsg in the figure. The second bridge 40 intersects the video lines VLa, VLb, and VLc, the power lines PL1*a*, PL1*b*, and PL1*c* and the reset line Srst and extends in the first direction X. The power lines PL1*a*, PL1*b*, and PL1*c* are connected to the second bridge 40 through a contact hole h40 penetrating the insulating layers 22 and 23 shown in FIG. 4.

The resistance of the conductive layer to supply the high potential Pvdd can be lowered by thus connecting the power lines PL1*a*, PL1*b*, and PL1*c* by the second bridge 40. The second bridge 40 extends over, for example, a plurality of pixels PX aligned in the first direction X, and is connected to the power lines PL1*a*, PL1*b*, and PL1*c* of each pixel PX. As another example, the second bridge 40 may be provided in the pixel PX one by one.

Figure 8:
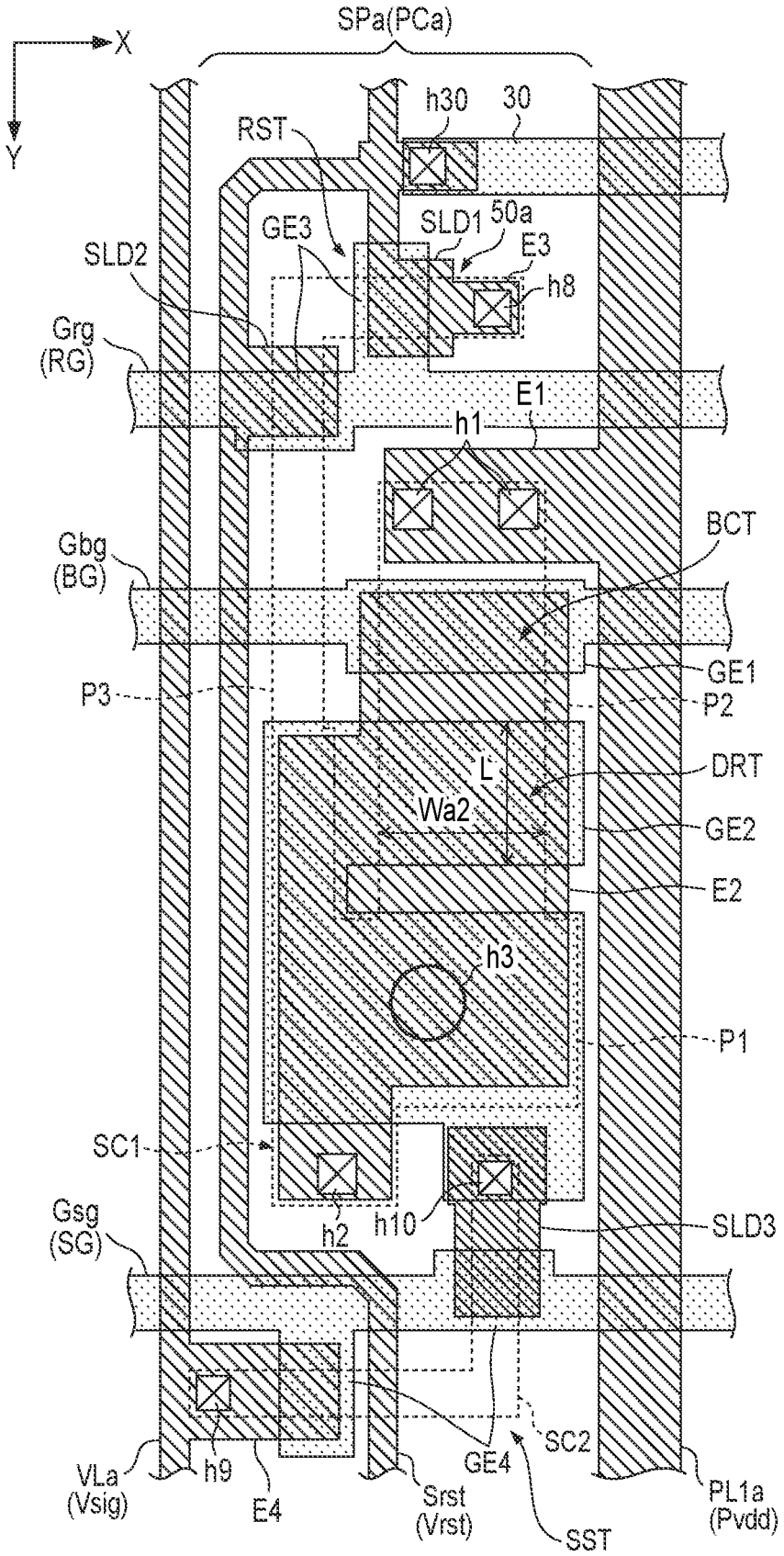
FIG. 8 is a schematic plan view showing a pixel circuit of a first sub-pixel shown in FIG. 7.
Figure 9:
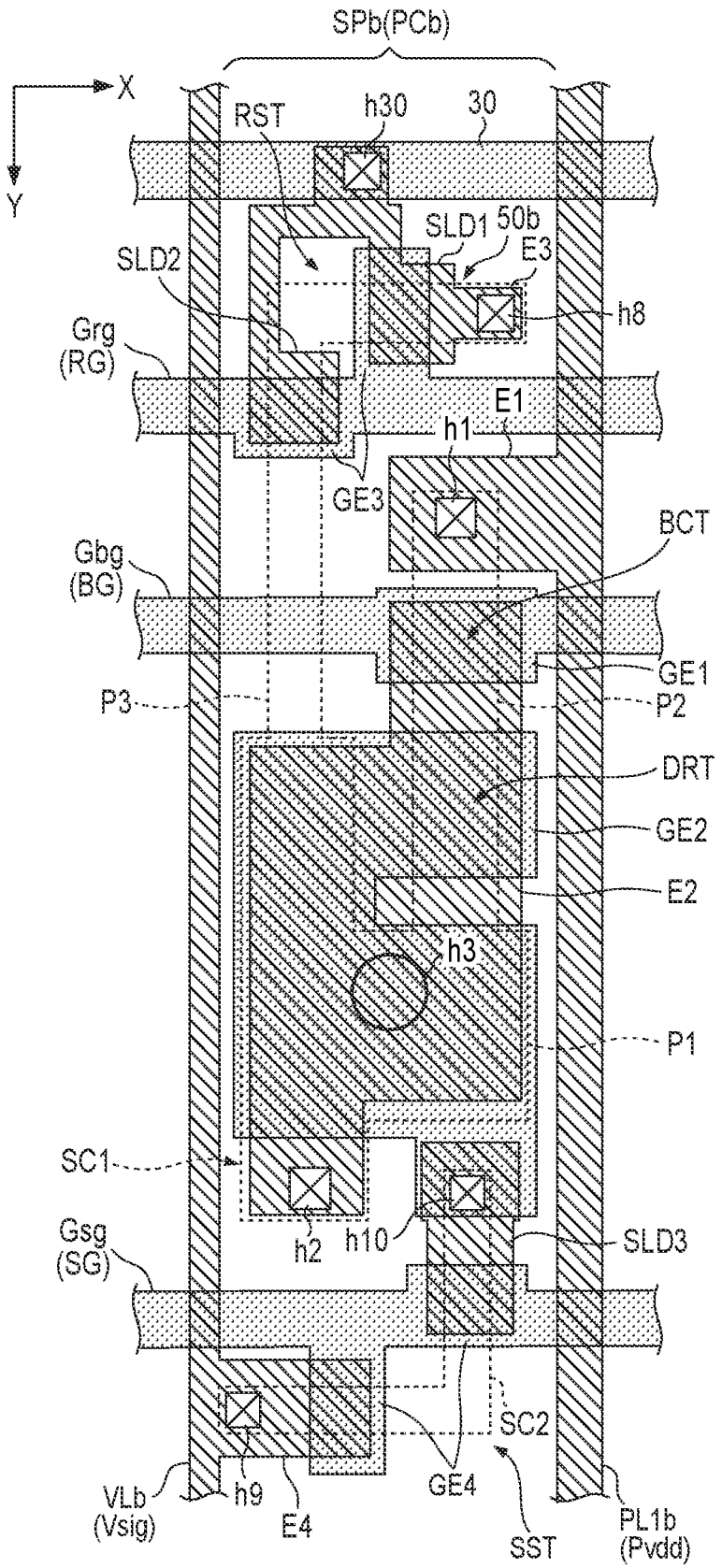
FIG. 9 is a schematic plan view showing a pixel circuit of a second sub-pixel shown in FIG. 7.

FIG. 8 is an enlarged schematic plan view showing the pixel circuit PCa shown in FIG. 7. FIG. 9 is an enlarged schematic plan view showing the pixel circuit PCb shown in FIG. 7. Detailed structures of the pixel circuits PCa, PCb, and PCc will be described hereinafter with reference to FIG. 8 and FIG. 9 in addition to FIG. 7.

As shown in FIG. 8, the scanning line Gbg includes a first gate electrode GE1 between the reset line Srst and the power line PL1*a*. In addition, a second gate electrode GE2 is arranged in a region surrounded by the scanning lines Gbg and Gsg, the video line VLa, and the power line PL1*a*. The first gate electrode GE1 and the second gate electrode GE2 are arranged in the first layer between the insulating layers 21 and 22 as shown in FIG. 4.

The first electrode E1 extends from the power line PL1*a* towards the reset line Srst, at a position between the scanning lines Grg and Gbg. In addition, the second electrode E2 in an island-like shape is arranged in a region surrounded by the scanning lines Grg and Gsg, the reset line Srst, and the power line PL1*a*. The second electrode E2 is arranged in the third layer at the position between the insulating layers 23 and 24 as shown in FIG. 4.

The semiconductor layer SC1 is arranged between the reset line Srst and the power line PL1*a*. The semiconductor layer SC1 includes a first part P1, and a second part P2 and a third part P3 that extend from the first part P1 in the second direction Y.

The second part P2 intersects the first gate electrode GE1 and the second gate electrode GE2. A distal end of the second part P2 is connected to the first electrode E1 through the contact hole h1 shown in FIG. 4. In the example of FIG. 8, two contact holes h1 arranged in the first direction X are provided. The output transistor BCT is configured by the first gate electrode GE1 and a part of the second part P2. The drive transistor DRT is configured by the second gate electrode GE2 and a part of the second part P2.

The scanning line Grg includes two third gate electrodes GE3 between the reset line Srst and the power line PL1*a*. The relay electrode 50*a* connected to the reset line Srst includes a third electrode E3. The third part P3 of the semiconductor layer SC1 intersects each third gate electrode GE3. A distal part of the third part P3 is connected to the third electrode E3 through a contact hole h8 which penetrates the insulating layer 23 shown in FIG. 4. The reset transistor RST is configured by the third gate electrode GE3 and the third part P3.

The video line VLa includes a fourth electrode E4 which protrudes toward the reset line Srst. The scanning line Gsg includes two fourth gate electrodes GE4 between the video line VLa and the power line PL1*a*. The semiconductor layer SC2 intersects each fourth gate electrode GE4. An end of the semiconductor layer SC2 is connected to the fourth electrode E4 through a contact hole h9 which penetrates the insulating layer 23 shown in FIG. 4. The other end of the semiconductor layer SC2 is connected to the second gate electrode GE2 through a contact hole h10 which penetrates the insulating layer 22 shown in FIG. 4. The pixel select transistor SST is configured by the fourth gate electrode GE4 and the semiconductor layer SC2.

The first part P1 of the semiconductor layer SC1 is connected to the second electrode E2 through the contact hole h2 which is also shown in FIG. 4. The second electrode E2 is opposed to most parts of the second gate electrode GE2 and forms the storage capacitor Cs shown in FIG. 3 together with the second gate electrode GE2. The contact hole h3 which is also shown in FIG. 4 and FIG. 6 is provided at the position where the second electrode E2 and the second gate electrode GE2 are overlaid.

The second electrode E2 is overlaid on the region where the second part P2 of the semiconductor layer SC1 intersects the first gate electrode GE1 in the output transistor BCT and the region where the second part P2 intersects the second gate electrode GE2 in the drive transistor DRT. The influence given to the operations of the output transistor BCT and the drive transistor DRT by the potential from the upper side of the semiconductor layer SC1 can be thereby inhibited.

The relay electrode 50*a* includes a shield SLD1. The reset line Srst includes a shield SLD2. The shields SLD1 and SLD2 are overlaid on a region where the third part P3 of the semiconductor layer SC1 intersects each third gate electrode GE3. The influence given to the operations of the reset transistor RST by the potential from the upper side of the semiconductor layer SC1 can be thereby inhibited.

A shield SLD3 formed in the third layer is arranged near the contact hole h10. The shield SLD3 is overlaid on a region where one of a pair of the fourth gate electrodes GE4 intersects the semiconductor layer SC2. In addition, the fourth electrode E4 is overlaid on a region where the other of the pair of the fourth gate electrode GE4 intersects the semiconductor layer SC2. The influence given to the operations of the pixel select transistor SST by the potential from the upper side of the semiconductor layer SC2 can be thereby inhibited.

As shown in FIG. 9, the configuration of the pixel circuit PCb of the sub-pixel SPb is basically similar to the configuration of the pixel circuit PCa shown in FIG. 8. In the pixel circuit PCb, however, the shield SLD2 is provided in the relay electrode 50*b*. In addition, only one contact hole h1 is provided to connect the first electrode E1 with the second part P2 of the semiconductor layer SC1. That is, the number of the contact holes h1 included in the pixel circuit PCa is more than the number of the contact holes h1 included in the pixel circuit PCb. The configuration of the pixel circuit PCc of the sub-pixel SPc is also similar to the configuration of the pixel circuit PCb.

Next, further features of the pixel circuits PCa, PCb, and PCc and various lines and advantages obtained from the embodiment will be described.

In general, the micro-LED emitting red light is lower in efficiency than the micro-LEDs emitting green light and blue light. For this reason, to urge the light emitting element 10*a* which is the micro-LED emitting red light to emit light with desired luminance, a higher current than the other light emitting elements 10*b* and 10*c* is required. Thus, improvement to make the current supplied to the light emitting element 10*a* higher is made in the layout shown in FIG. 7.

More specifically, in the example of FIG. 7, a width Wa1 in the first direction X of the power line PL1*a* which supplies the high potential Pvdd to the light emitting element 10*a* is larger than widths Wb1 and Wc1 in the first direction X of the other power lines PL1*b* and PL1*c*. Thus, the resistance of the power line PL1*a* can be lowered and the current flowing to the light emitting element 10*a* can be made higher. The width Wa1 is, for example, 1.5 times or more as large as the widths Wb1 and Wc1. For example, the width Wa1 is 5.5 μm, and each of the widths Wb1 and Wc1 is 3.0 μm.

In addition, in the embodiment, the shape and the like of the semiconductor layer SC1 are determined such that a channel ratio Ra (first channel ratio) of the drive transistor DRT of the pixel circuit PCa is larger than channel ratios Rb and Rc (second and third channel ratios) of the drive transistors DRT of the other pixel circuits PCb and PCc, in order to further increase the current flowing to the light emitting element 10*a*.

The channel ratio Ra corresponds to a value (Wa2/L) obtained by dividing a channel width Wa2 shown in FIG. 8 by a channel length L. The channel width Wa2 is a length in the first direction X of the region where the second part P2 of the semiconductor layer SC1 intersects the second gate electrode GE2, and the channel length L is a length in the second direction Y of this region. The channel ratios Rb and Rc can also be defined in the same manner.

In the embodiment, the channel length L of the drive transistor DRT is equal in the pixel circuits PCa, PCb, and PCc. In contrast, as shown in FIG. 7, the channel width Wa2 is larger than the channel widths Wb2 and Wc2 of the drive transistors DRT of the respective pixel circuits PCb and PCc. The channel ratio Ra is thereby made higher than the channel ratios Rb and Rc. The channel width Wa2 is desirably 1.5 times or more as large as the channel width Wb2 and, more desirably, 2 times or more as large as the channel width Wb2. For example, the window width Wa2 is 11.0 μm, and the window width Wb2 is 5.5 μm.

The channel ratio Rc may be the same as or different from the channel ratio Rb. In the example of FIG. 7, the window width Wc2 is larger than the window width Wb2. Therefore, the channel ratio Rc is larger than the channel ratio Rb. In this case, the current flowing to the light emitting element 10*c* can be more increased than the current flowing to the light emitting element 10*b*.

Incidentally, when the width Wa1 of the power line PL1*a* and the channel width Wa2 are increased in the sub-pixel SPa, the width Wx in the first direction X of the pixel PX can also be increased. The increase in the width Wx inhibits high definition of the pixel PX. In this regard, in the embodiment, the increase in the width Wx is inhibited by not providing the reset line Srst to each of the sub-pixels SPa, SPb, and SPc, but achieving commonality of the reset line Srst in the sub-pixels SPa, SPb, and SPc. For example, the width Wx is 96.0 μm. In addition, the width Wy in the second direction Y of the pixel PX is also 96.0 μm.

In the example of FIG. 7, the width Wa3 of the sub-pixel SPa is larger than the widths Wb3 and Wc3 of the other sub-pixels SPb and SPc. For example, when the width Wx is 96.0 μm, the width Wa3 is 37 μm, and each of the widths Wb3 and Wc3 is 29.5 μm. By thus increasing the width Wa3 of the sub-pixel SPa, the width Wa1 of the power line PL1*a* and the channel width Wa1 can be increased and space for arranging the reset line Srst between the video line VLa and the power line PL1*a* can be secured.

As described above, according to the layout of the pixel circuits PCa, PCb, and PCc and various lines as exemplified in the embodiment, the increase in the size of the pixel PX can be inhibited while increasing the luminance of the light emitting element 10*a*. As a result, the increase in luminance and the enhancement in high definition of the display device 1 can be implemented. Besides this, various desirable advantages can be obtained from the embodiment.

In the embodiment, the sub-pixels SPa, SPb, and SPc are examples of the first sub-pixel, the second sub-pixel and the third sub-pixel, respectively. The pixel circuits PCa, PCb, and PCc are examples of the first pixel circuit, the second pixel circuit and the third pixel circuit. The light emitting elements 10*a*, 10*b*, and 10*c* are examples of the first light emitting element, the second light emitting element, and the third light emitting element. The video lines VLa, VLb, and VLc are examples of the first video line, the second video line, and the third video line. The power lines PL1*a*, PL1*b*, and PL1*c* are examples of the first power line, the second power line, and the third power line. The drive transistors DRT of the pixel circuits PCa, PCb, and PCc are examples of the first drive transistor, the second drive transistor, and the third drive transistor.

Incidentally, in the embodiment, the reset line Srst is located between the video line VLa and the power line PL1*a*. As another example, the reset line Srst may be located between the power line PL1*a* and the video line VLb, between the video line VLb and the power line PL1*b*, between the power line PL1*b* and the video line VLc, or between the video line VLc and the power line PL1*c*.

In addition, the reset line Srst is arranged together with the video lines VLa, VLb, VLc, and the like in the first direction X and extends in the second direction Y. As another example, the reset line Srst may be arranged together with the scanning lines Grg, Gbg, and Gsg in the second direction Y and may extend in the first direction X. In this case, by achieving the commonality of the reset line Srst in the sub-pixel SPa, SPb, SPc, the width Wy in the second direction Y of the pixel PX can be reduced as compared with a case of providing the reset line Srst for each of the sub-pixels SPa, SPb, and SPc.

In addition, in the embodiment, it is exemplified that the object where the width of the power line PL1 and the channel ratio of the drive transistor DRT are increased is the red sub-pixel SPa. However, the width of the power line PL1 and the channel ratio of the drive transistor DRT may be increased in the sub-pixels SP of the other colors.

All of the display devices that can be implemented by a person of ordinary skill in the art through arbitrary design changes to the display devices described above as embodiments of the present invention come within the scope of the present invention as long as they are in keeping with the spirit of the present invention.

Various types of the modified examples are easily conceivable within the category of the ideas of the present invention by a person of ordinary skill in the art and the modified examples are also considered to fall within the scope of the present invention. For example, additions, deletions or changes in design of the constituent elements or additions, omissions, or changes in condition of the processes arbitrarily conducted by a person of ordinary skill in the art, in the above embodiments, fall within the scope of the present invention as long as they are in keeping with the spirit of the present invention.

In addition, the other advantages of the aspects described in the embodiments, which are obvious from the descriptions of the present specification or which can be arbitrarily conceived by a person of ordinary skill in the art, are considered to be achievable by the present invention as a matter of course.

What is claimed is:

1. A display device comprising:

a first sub-pixel including a first light emitting element and a first pixel circuit driving the first light emitting element;

a second sub-pixel including a second light emitting element and a second pixel circuit driving the second light emitting element;

a third sub-pixel including a third light emitting element and a third pixel circuit driving the third light emitting element;

a first power line for supplying power to the first pixel circuit;

a second power line for supplying power to the second pixel circuit;

a third power line for supplying power to the third pixel circuit;

a reset line to which a reset signal for resetting voltages of the first light emitting element, the second light emitting element and the third light emitting element is supplied;

a first video line and a second video line arranged in a first direction in the display region, and supplying video signals to the first pixel circuit and the second pixel circuit, respectively;

a plurality of scanning lines arranged in a second direction intersecting the first direction in the display region, and supplying scanning signals to the first pixel circuit and the second pixel circuit, respectively; and a first bridge arranged in a layer different from the first power line and intersecting the first power line, wherein the reset line, the first power line, the second power line and the third power line are arranged in a display region including the first sub-pixel, the second sub-pixel and the third sub-pixel, the reset line is connected to the first pixel circuit, the second pixel circuit and the third pixel circuit, a width of the first power line is larger than a width of the second power line and a width of the third power line, the first light emitting element is a red light-emitting diode, the third light emitting element is a blue light-emitting diode, the reset line, the first power line, and the second power line are arranged in the first direction, the first power line, the second power line, the reset line, the first video line, and the second video line are arranged in a same layer, the first video line, the first power line, the second video line, and the second power line are arranged in this order in the first direction, the reset line is connected to the first pixel circuit and the first bridge between the first video line and the first power line, and the first bridge is connected to the second pixel circuit between the second video line and the second power line.

2. The display device of claim 1, wherein the first sub-pixel and the second sub-pixel are arranged in the first direction, and a width in the first direction of the first sub-pixel is larger than a width in the first direction of the second sub-pixel.

3. The display device of claim 1, further comprising:

a second bridge arranged in a layer different from the reset line, the first power line, and the second power line, wherein the second bridge intersects the reset line, and connects the first power line with the second power line.

4. The display device of claim 1, wherein the first pixel circuit comprises a first drive transistor connected to the first light emitting element, the second pixel circuit comprises a second drive transistor connected to the second light emitting element, and a first channel ratio obtained by dividing a channel width of the first drive transistor by a channel length of the first drive transistor is larger than a second channel ratio obtained by dividing a channel width of the second drive transistor by a channel length of the second drive transistor.

5. The display device of claim 4, wherein the third sub-pixel configures one pixel together with the first sub-pixel and the second sub-pixel.

6. A display device comprising:

a first sub-pixel including a first light emitting element and a first pixel circuit driving the first light emitting element;

a second sub-pixel including a second light emitting element and a second pixel circuit driving the second light emitting element;

a third sub-pixel including a third light emitting element and a third pixel circuit driving the third light emitting element;

a first power line for supplying power to the first pixel circuit;

a second power line for supplying power to the second pixel circuit;

a third power line for supplying power to the third pixel circuit; and a reset line to which a reset signal for resetting voltages of the first light emitting element, the second light emitting element and the third light emitting element is supplied, wherein the reset line, the first power line, the second power line and the third power line are arranged in a display region including the first sub-pixel, the second sub-pixel and the third sub-pixel, the reset line is connected to the first pixel circuit, the second pixel circuit and the third pixel circuit, a width of the first power line is larger than a width of the second power line and a width of the third power line, the first light emitting element is a red light-emitting diode, the third light emitting element is a blue light-emitting diode, the first pixel circuit comprises a first drive transistor connected to the first light emitting element, the second pixel circuit comprises a second drive transistor connected to the second light emitting element, a first channel ratio obtained by dividing a channel width of the first drive transistor by a channel length of the first drive transistor is larger than a second channel ratio obtained by dividing a channel width of the second drive transistor by a channel length of the second drive transistor, the third pixel circuit comprises a third drive transistor connected to the third light emitting element, and a third channel ratio obtained by dividing a channel width of the third drive transistor by a channel length of the third drive transistor is smaller than the first channel ratio and is different from the second channel ratio.

7. A display device comprising:

a first sub-pixel including a first light emitting element and a first pixel circuit driving the first light emitting element;

a second sub-pixel including a second light emitting element and a second pixel circuit driving the second light emitting element;

a third sub-pixel including a third light emitting element and a third pixel circuit driving the third light emitting element;

a first video line for supplying a video signal to the first pixel circuit;

a second video line for supplying a video signal to the second pixel circuit;

a third video line for supplying a video signal to the third pixel circuit; and a reset line in which a reset signal for resetting voltages of the first light emitting element, the second light emitting element, and the third light emitting element is supplied, wherein the reset line includes a wiring part and a bridge part, the first video line, the wiring part of the reset line, the second video line, and the third video line are arranged in this order in the first direction, the first video line, the second video line, and the third video line extend in a second direction intersecting the first direction, the wiring part of the reset line extends in the second direction at a position between the first video line and the second video line, and the bridge part of the reset line intersects the second video line and the third video line and extends in the first direction.

8. The display device of claim 7, wherein the first pixel circuit comprises a pixel select transistor connected to the first video line, and the wiring part of the reset line is formed to bypass the pixel select transistor.

9. The display device of claim 8, wherein the first pixel circuit comprises a first reset transistor connected to the reset line, the second pixel circuit comprises a second reset transistor connected to the bridge part of the reset line, the third pixel circuit comprises a third reset transistor connected to the bridge part of the reset line, each of the first reset transistor, the second reset transistor, and the third reset transistor comprises two gate electrode, and the reset line includes two shield electrodes overlaid on the two gate electrodes of the first reset transistor, two shield electrodes overlaid on the two gate electrodes of the second reset transistor, and two shield electrodes overlaid on the two gate electrodes of the third reset transistor.

* * * * *